United States Patent [19]

Janhonen

[11] Patent Number: 4,624,407

[45] Date of Patent: Nov. 25, 1986

[54] PACKAGE AND METHOD FOR FABRICATION THEREOF

[76] Inventor: Veikko I. Janhonen, Långvik, 02420 Jorvas, Finland

[21] Appl. No.: 686,266

[22] PCT Filed: Apr. 13, 1984

[86] PCT No.: PCT/FI84/00030

§ 371 Date: Dec. 6, 1984

§ 102(e) Date: Dec. 6, 1984

[87] PCT Pub. No.: WO84/04083

PCT Pub. Date: Oct. 25, 1984

[30] Foreign Application Priority Data

Apr. 14, 1983 [FI] Finland ..... 831255

[51] Int. Cl.[4] ..... B65D 37/00; B65D 35/20

[52] U.S. Cl. ..... 229/1.5 R; 383/120

[58] Field of Search ..... 229/1.5 R, 68 R; 383/120

[56] References Cited

U.S. PATENT DOCUMENTS

| | | | |
|---|---|---|---|
| 1,112,042 | 9/1914 | Ullman | 229/68 R |
| 1,373,222 | 3/1921 | Bushnell, Jr. | 229/68 R |
| 1,682,458 | 8/1928 | Ahlquist | 229/68 R |
| 3,063,610 | 11/1962 | Rhoten | 229/68 R |
| 3,765,596 | 10/1973 | Garrod | 229/68 R |
| 4,325,507 | 4/1982 | Janhonen | 229/68 R |

*Primary Examiner*—Stephen P. Garbe

*Attorney, Agent, or Firm*—Price, Heneveld, Huizenga & Cooper

[57] ABSTRACT

A package and method for fabrication thereof. A basic cardboard (1) is double-folded as the covers of a book and glued between the halves is paper (2) for sealing the side edges of a package. For stiffening the side edges, the edges of said sheet (2) of paper are double-folded and glued for two-layer paper (3). These two-fold marginal or edge portions (3) of said paper sheet (2) are folded along a bending line (6) providing the side edge of a package and the twofold paper is affixed to each half of basic cardboard (1), the side edge of a package thus being sealed with two-layer paper.

2 Claims, 3 Drawing Figures

PACKAGE AND METHOD FOR FABRICATION THEREOF

The present invention relates to a package, comprising a basic cardboard, which is double-folded as the covers of a book and between whose halves is affixed with an adhesive to the surface of each half a paper or paperboard for sealing the side edges of a package. The invention is also directed to a method for fabrication of such a package.

This type of package is disclosed in the Applicant's U.S. Pat. No. 3,926,364. A drawback in this prior art package is that the paper sealing the side edges of a package is easily ripped and a product to be packed will slip out through a ripped-up side edge.

A similar type of package is also set out in the Applicant's Canadian Patent publication No. 1 131 534. The same drawback is present there as well, since the side edge is sealed by a single layer of paper at the side edge folding.

An object of the invention is to provide the above type of package which can be fabricated with as little material consumption as possible by means of a simple automatic machine at a high rate of production in a manner that the side edge of a package will be sealed either with pasteboard or two-layer paper.

This object is achieved on the basis of the characteristics of the invention set out in the annexed claims.

Figure 1:
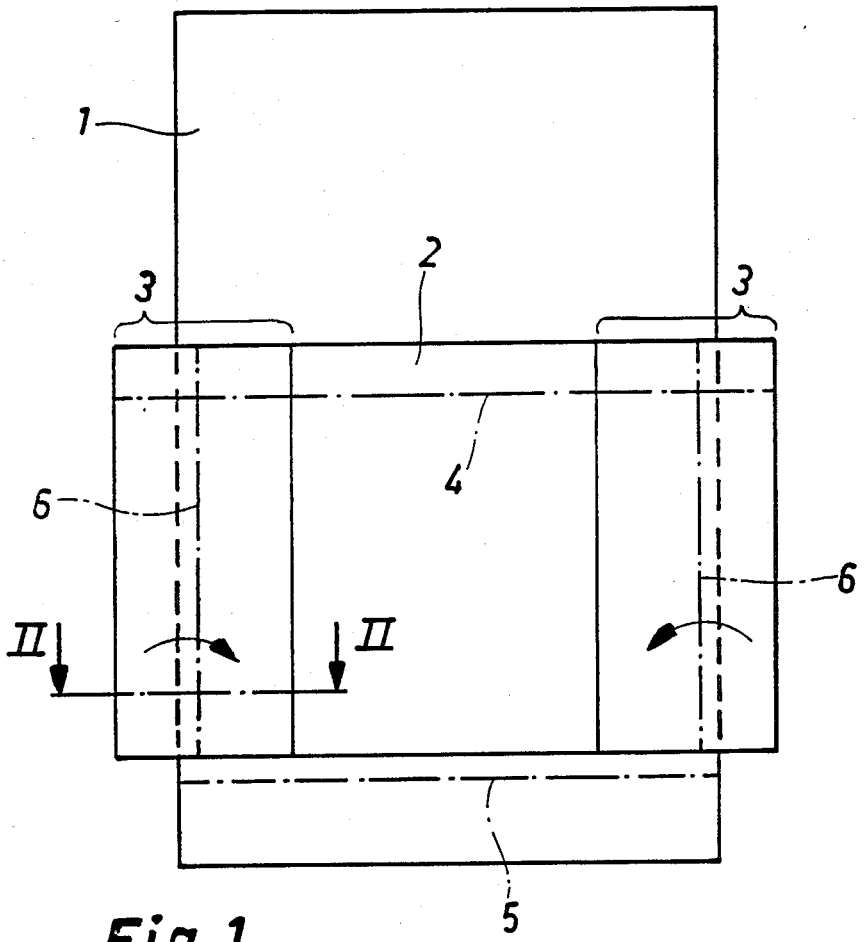
Figure 2:
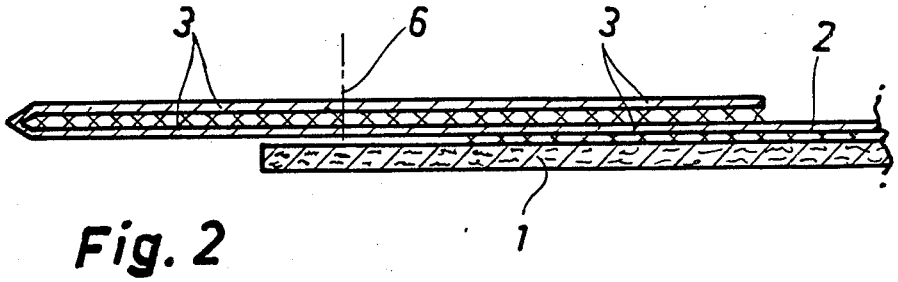

One embodiment of the invention will now be described in more detail with reference made to the accompanying drawings, in which FIG. 1 shows the blank of a package according to the invention in one intermediate stage of fabrication and FIG. 2 is a section taken along line II—II in FIG. 1.

Figure 3:
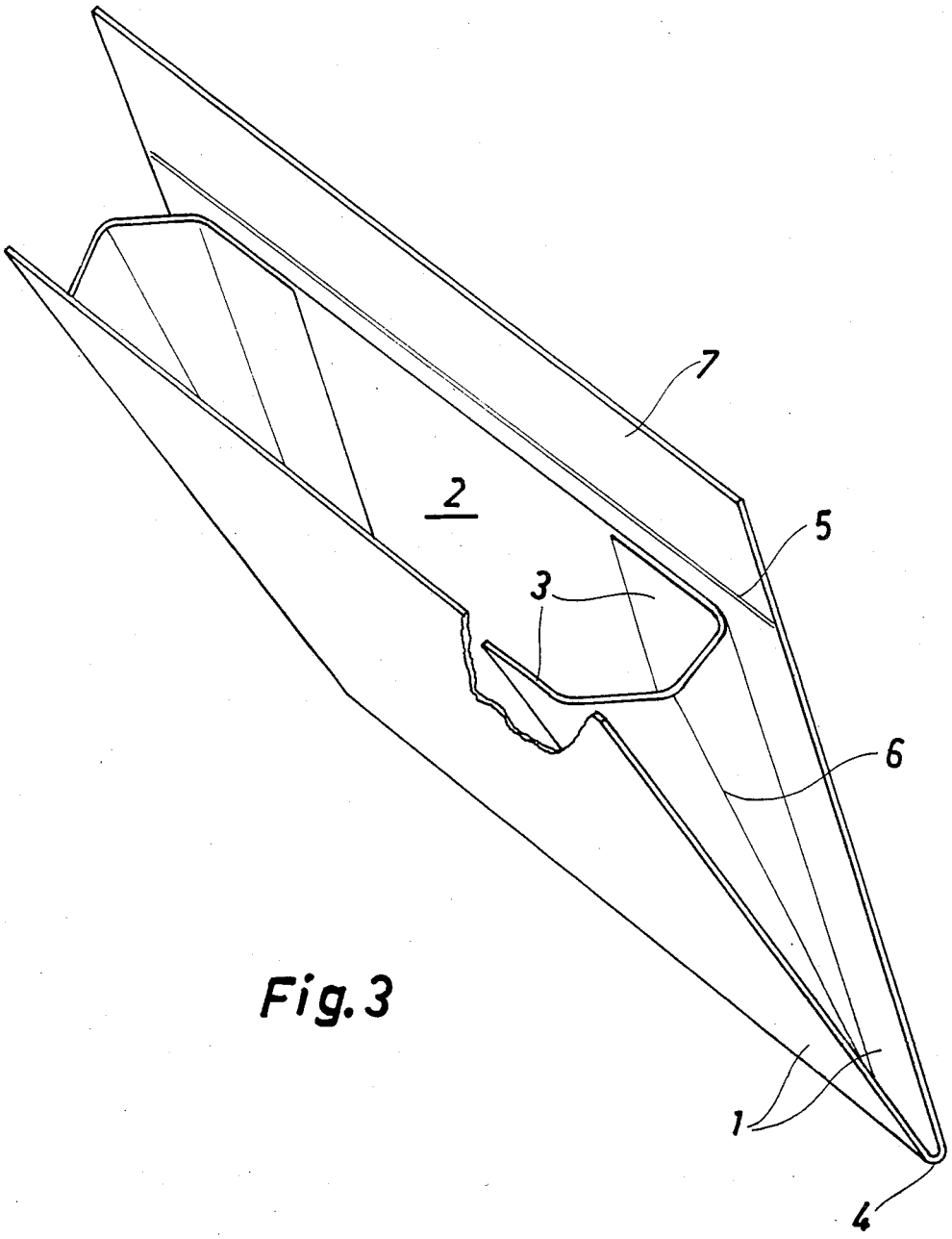

FIG. 3 is a perspective and partially cut-away view of a finished package.

First to be described is the design of a package. A basic cardboard 1 is folded the same way as the covers of a book, a bending line 4 forming the bottom of a package. Affixed with an adhesive to one side face of basic cardboard 1 is a sheet of paper 2, whose edges are double-folded and glued to each other for a two-layer paper 3. This two-layer paper 3 is folded at side edge 6 of a package and affixed with an adhesive to the other half of basic cardboard 1, said other half having no sheet of paper 2. Thus, the side edges of basic cardboard 1 will be sealed with two-layer paper, as shown in FIG. 3. Sheet of paper 2 may be replaced with a slightly thicker sheet of pasteboard for eliminating the need for twofold edge portions 3.

The bottom bending line 4 of basic cardboard 1 is so located that one half of the basic cardboard will be longer than the other, the longer half being provided with a bending line 5 for separating a closing flap 7.

A bending line 6 for the ends of paper or pasteboard sheet 2 is located between the cardboard halves slightly inside the side edges of cardboard 1, the edges of cardboard 1 protecting a wrapped-up product from blows. When said side edge bend 6 is provided with a two-layer paper 3 or a tough, thin pasteboard, the side edges won't be torn open when packing a product.

On the other hand, this package can be fabricated with a simple automatic machine at a high rate of production. The following description will deal with the fabrication method of such package. A cardboard web to be run from a supply roller is cut into rectangular cardboard lengths 1. Another supply roller is run at approximately half of the previous rate to deliver paper web, whose width is approximately double compared to that of cardboard web 1. Prior to the cutting stage, the edges of paper are double-folded and glued to each other for two-layer paper 3. Even after this folding, the width of paper web substantially exceeds that of cardboard 1. Thereafter, the paper web is cut into paper sheets 2 whose length is approximately half of that of cardboard 1. A paper sheet 2 is placed on cardboard 1 according to FIG. 1 so as to extend a small distance beyond the bottom bending line 4 of a future package. One edge lies close to a bending line 5 separating said closing flap 7. The lengthwise center axes of cardboard 1 and sheet 2 join each other. An adhesive has been applied to the top of cardboard 1 within the zone covered by sheet 2 for fixing the opposite faces of sheet 2 and cardboard 1 to each other. However, the adhesive-covered area does not extend quite up to the edges of cardboard 1. The adhesive-covered area extends to the zone of two-layer paper 3 but stops a small distance short of bending line 6 of two-layer paper 3. Thereafter, the twofold marginal sections 3 of sheet 2 are bent along bending lines 6 and an adhesive is applied to either or both of those faces of the bent marginal sections of paper sheet 2 and cardboard 1, which will be against each other as cardboard 1 is double-folded along bottom bending line 4. It will be appreciated that following this the twofold margianal section 3 of paper sheet 2 will be affixed to both halves of cardboard 1, the side edge of cardboard being thus sealed by two-layer paper.

A sheet of paper 2 can be replaced with tough, thin, flexible pasteboard whose ends need not be double-folded. Still achieved is improved strength combined with low consumption of material and high-speed fabrication technique.

It will be appreciated that all steps in the method can be carried out with simple machinery at a high rate of production since all that is required is cutting off the webs, double-folding them, and applying an adhesive.

It should also be appreciated that the relative positioning of various sections and application of an adhesive do not require great accuracy. A sheet of paper or pasteboard 2 is substantially easier to place in a proper position than positioning separate marginal strips (see Canadian Patent publication No. 1 131 534).

I claim:

1. An envelope shaped package having reinforced end walls, said package comprising:

a first elongated rectangular sheet of a stiff cardboard type material, said sheet having three panels separated by laterally extending fold lines, one of said panels being a back panel, a second panel being a front panel, and the third panel being a closure flap, the fold line between said front and back panels defining a bottom of said package; and a second elongated rectangular sheet of flexible material arranged at right angles to said first sheet and overlying said back panel, a portion of said second sheet extending over the fold line between said front and back panels and overlying said front panel, the length of said second sheet being greater than the width of said first sheet, the ends of said second sheet extending laterally beyond each lateral edge of said first sheet and being folded back upon and bonded to themselves along fold lines spaced outwardly from said lateral edges of said first sheet, to form double thickness end panels, said end panels being folded along fold lines spaced inwardly from said lateral edges of said first sheet and bonded to said front panel, the portions of the end panels overlying the front panel being folded against the portions of the end panels overlying said back panel to seal and reinforce the bottom and bottom corners of the package.

2. An envelope shaped package as described in claim 1 wherein said first and second sheets are bonded to each other in their area of overlap except along a narrow strip adjacent each lateral edge of said first sheet.

* * * * *